US007181795B2

(12) United States Patent
Wu

(10) Patent No.: US 7,181,795 B2
(45) Date of Patent: Feb. 27, 2007

(54) MULTI-CHAMBER INFLATABLE BED WITH UNIDIRECTIONAL AIR INLET UNIT BETWEEN CHAMBERS

(75) Inventor: Hsin-Tsai Wu, Taipei (TW)

(73) Assignee: Coleman Company, Inc. (TW)

( * ) Notice: Subject to any disclaimer, the term of this patent is extended or adjusted under 35 U.S.C. 154(b) by 0 days.

(21) Appl. No.: 11/165,954

(22) Filed: Jun. 24, 2005

(65) Prior Publication Data

US 2006/0174416 A1 Aug. 10, 2006

(30) Foreign Application Priority Data

Feb. 6, 2005 (CN) ..... 2005 2 0000481

(51) Int. Cl.
*A47C 27/10* (2006.01)

(52) U.S. Cl. ..... 5/710; 5/712

(58) Field of Classification Search ..... 5/706, 5/710–715

See application file for complete search history.

(56) References Cited

U.S. PATENT DOCUMENTS

| | | | | |
|---|---|---|---|---|
| 1,282,980 | A * | 10/1918 | Tabach | 5/706 |
| 6,047,423 | A * | 4/2000 | Larson | 5/709 |
| 6,463,610 | B1 * | 10/2002 | Shulte et al. | 5/712 |
| 6,598,250 | B1 * | 7/2003 | Pekar | 5/654 |
| 6,618,884 | B1 * | 9/2003 | Wu | 5/706 |
| 2003/0159218 | A1 * | 8/2003 | Lin et al. | 5/710 |

* cited by examiner

*Primary Examiner*—Michael Trettel
(74) *Attorney, Agent, or Firm*—Ostrolenk, Faber, Gerb & Soffen, LLP

(57) ABSTRACT

An inflatable bed includes an enclosure member defining a receiving space, an inner partition sheet disposed within the enclosure member and dividing the receiving space into first and second chambers, an air valve attached to the enclosure member and communicating fluidly with the first chamber, and a unidirectional air inlet unit attached to the inner partition sheet and communicating fluidly with the first and second chambers. Air from the first chamber enters the second chamber through the unidirectional air inlet unit.

4 Claims, 3 Drawing Sheets

MULTI-CHAMBER INFLATABLE BED WITH UNIDIRECTIONAL AIR INLET UNIT BETWEEN CHAMBERS

CROSS-REFERENCE TO RELATED APPLICATION

This application claims priority of Chinese Application No. 2005200004812, filed on Feb. 06, 2005.

BACKGROUND OF THE INVENTION

1. Field of the Invention

The invention relates to an inflatable bed, more particularly to a multi-chamber inflatable bed.

2. Description of the Related Art

Referring to FIG. 1, a conventional multi-chamber airbed 1, as disclosed in U.S. Pat. No. 6,463,610, is shown to include a first chamber 11 and a second chamber 12. Each of the first and second chambers 11, 12 has an air valve 111, 121. Although the first and second chambers 11, 12 are configured to be isolated from each other so that air in the second chamber 12 cannot flow into the first chamber 11, and vice versa, the first and second chambers 11, 12 have to be inflated separately during use.

SUMMARY OF THE INVENTION

Therefore, the object of the present invention is to provide a multi-chamber inflatable bed that has a unidirectional air inlet unit between chambers so that the chambers can be inflated simultaneously.

According to this invention, an inflatable bed comprises an enclosure member defining a receiving space, an inner partition sheet disposed within the enclosure member and dividing the receiving space into a first chamber and a second chamber, an air valve attached to the enclosure member and communicating fluidly with the first chamber, and a unidirectional air inlet unit attached to the inner partition sheet and communicating fluidly with the first and second chambers. Air from the first chamber enters the second chamber through the unidirectional air inlet unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
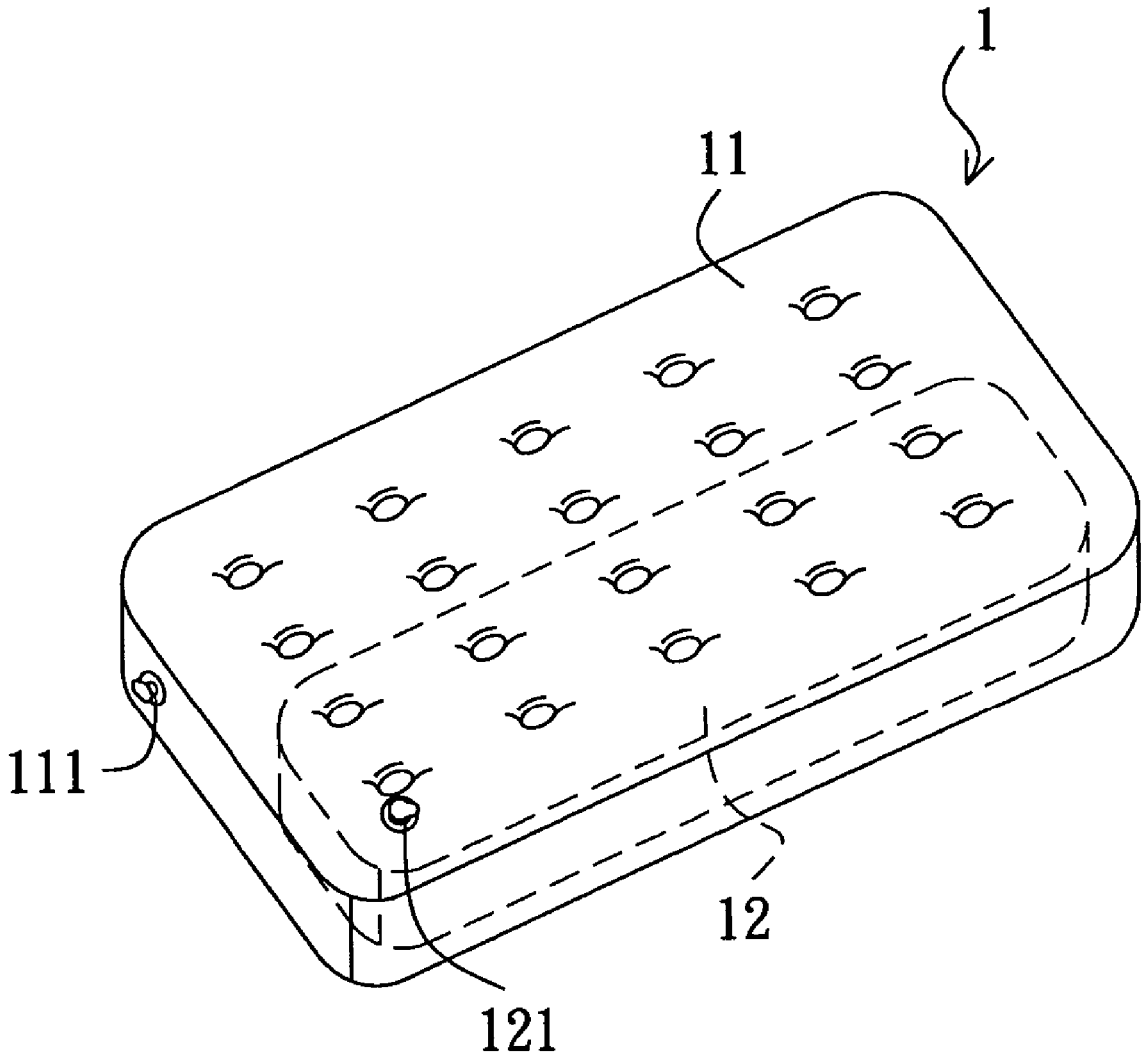
F I G. 1 PRIOR ART
FIG. 1 illustrates a conventional multi-chamber airbed according to U.S. Pat. No. 6,463,610.
Figure 2:
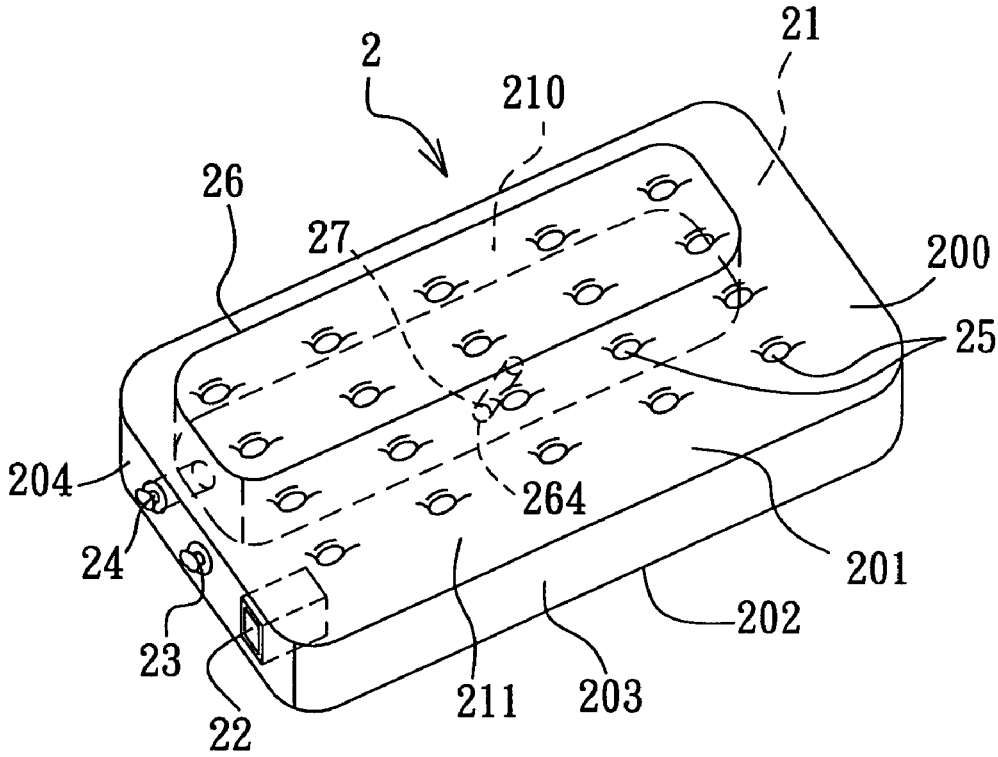
FIG. 2 is a perspective view of the preferred embodiment of a multi-chamber inflatable bed according to the present invention.
Figure 3:
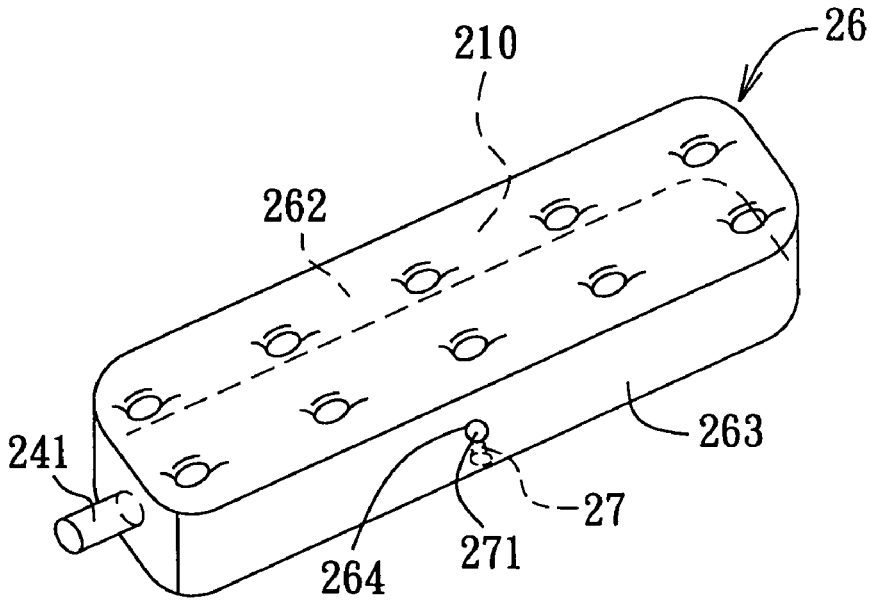
FIG. 3 is a perspective view of a second chamber of the preferred embodiment.
Figure 4:
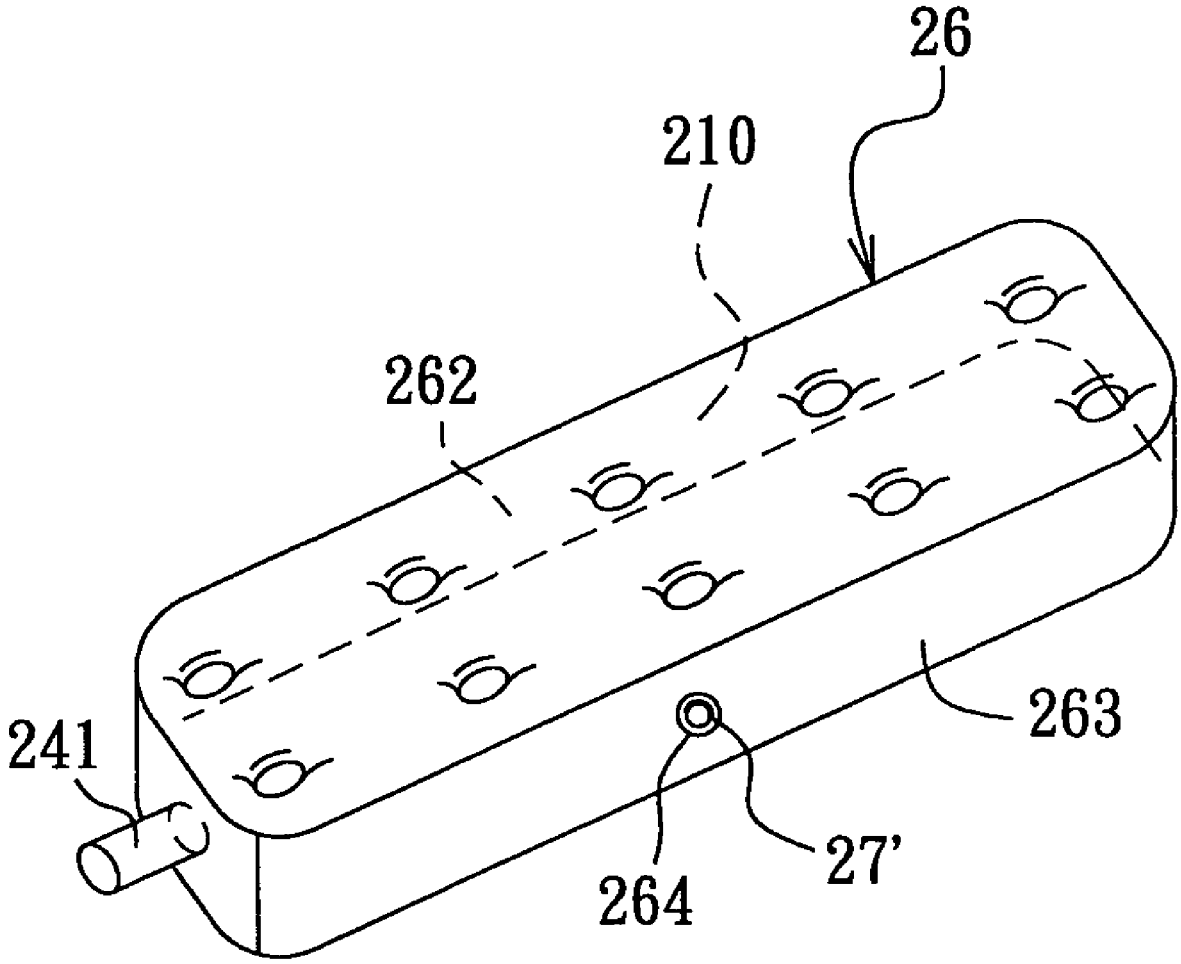
FIG. 4 is a view similar to FIG. 3, but illustrating an alternative form of a unidirectional air inlet unit.

Referring to FIGS. 2 to 4, the preferred embodiment of a multi-chamber inflatable bed 2 according to the present invention is shown to comprise an enclosure member 200, an inner partition sheet 26, a first air valve 23, a self-inflating/deflating device 22, a second air valve 24, a plurality of retention members 25, and a unidirectional air inlet unit.

The enclosure member 200 defines a receiving space 21, and includes a top sheet 201, a bottom sheet 202, and an outer peripheral sheet 203 connected to the top and bottom sheets 201, 202 through a high frequency sealing method to define the receiving space 21.

In this embodiment, the inner partition sheet 26 is a four-sided member disposed within the enclosure member 200, and has top and bottom ends connected respectively to the top and bottom sheets 201, 202 of the enclosure member 200 through the high frequency sealing method so as to divide the receiving space 21 into a first chamber 211 and a second chamber 210 surrounded by the first chamber 211 and defined by the inner partition sheet 26. The inner partition sheet 26 further has a first lateral side 262, a second lateral side 263 opposite to the first lateral side 262, and a through hole 264 formed in the second lateral side 263.

The self-inflating/deflating device 22 is attached to one side 204 of the outer peripheral sheet 203. In this embodiment, the self-inflating/deflating device 22 is a blower. Alternatively, the self-inflating/deflating device 22 may be a mini air pump or a compressor. The self-inflating/deflating device 22 supplies air into the multi-chamber inflatable bed 2 to inflate the same and expels air from the first chamber 211 to the atmosphere to deflate the multi-chamber inflatable bed 2.

The first air valve 23 is attached to the side 204 of the outer peripheral sheet 203, and communicates fluidly with the first chamber 211.

An air inlet/outlet tube 241 has two opposite ends connected respectively to the side 204 of the outer peripheral sheet 203 and the inner partition sheet 26. The second air valve 24 is connected to the air inlet/outlet tube 241 for controlling air flow therethrough.

The retention members 25 are disposed in the first and second chambers 211, 210, and are welded between the top and bottom sheets 201, 202 through the high frequency sealing method. The retention members 25 serve to maintain a distance between the top and bottom sheets 201, 202 so as to prevent the top and bottom sheets 201, 202 from stretching away from each other when the bed 2 is inflated. Further, the presence of the retention members 25 is such that when the multi-chamber inflatable bed 2 is inflated, the top sheet 201 is formed with a plurality of indentations and protrusions. As a result, when a user lies on the multi-chamber inflatable bed 2, there are gaps formed between the user's body and the top sheet 201 to permit air circulation.

The unidirectional air inlet unit is attached to the inner partition sheet 26, and communicates fluidly with the first and second chambers 211, 210. The unidirectional air inlet unit includes a flexible tube 27 having one end 271 connected to the through hole 264 so that the flexible tube 27 is hung on the inner partition sheet 26.

When the first chamber 211 is filled with air to a predetermined pressure level through activation of the self-inflating/deflating device 22, air in the first chamber 211 enters the second chamber 210 through the flexible tube 27 and stops only when the air pressure in the second chamber 210 is equal to the air pressure in the first chamber 211, or when the self-inflating/deflating device 22 is deactivated. The second chamber 210 may also be inflated by using an air pump that is connected to the second air valve 24 so as to speed up the inflation process.

The unidirectional air inlet unit in this embodiment includes a flexible tube. In an alternative embodiment, as shown in FIG. 4, the unidirectional air inlet unit includes a check valve 27' connected to the through hole 264. Further, the unidirectional air inlet unit may include other kinds of valves which can control the flow of air in a single direction.

Although only one flexible tube 27 is cited in the embodiment of FIGS. 2 and 3, the flexible tube 27 may be increased in number as needed and depending on the size and shape of the multi-chamber inflatable bed 2. Moreover, the mounting locations of each of the first and second air valves 23, 24 and of the self-inflating/deflating device 22 may be altered to best suit the desired outer appearance of the multi-chamber inflatable bed 2, and are not limited to the side 204 of the outer peripheral sheet 203.

From the aforementioned description, it is apparent that air enters the second chamber 210 through the flexible tube 27. When air is no longer supplied into the first chamber 211, air stops entering the second chamber 210, and the flexible tube 27 droops from the inner partition sheet 26 and lays flat, thereby preventing air from flowing into the first chamber 211 from the second chamber 210.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An inflatable bed comprising:

an enclosure member defining a receiving space;

an inner partition sheet disposed within said enclosure member and dividing said receiving space into a first chamber and a second chamber;

said enclosure member includes a top sheet, a bottom sheet, and an outer peripheral sheet connected to said top and bottom sheets to define said first chamber, said inner partition sheet extending between said top and bottom sheets, and having a through hole formed therein, said inner partition sheet further having top and bottom ends connected respectively to said top and bottom sheets;

a first air valve attached to said enclosure member and communicating fluidly with said first chamber; and a unidirectional air inlet unit attached to said inner partition sheet and communicating fluidly with said first and second chambers;

wherein air from said first chamber enters said second chamber through said unidirectional air inlet unit;

said unidirectional air inlet unit includes a flexible tube having one end connected to said through hole so that said flexible tube is hung on said inner partition sheet, said flexible tube being capable of laying flat and drooping from said inner partition sheet so as to prevent air from flowing into said first chamber from said second chamber.

2. The inflatable bed as claimed in claim 1, further comprising a self-inflating/deflating device attached to said enclosure member to inflate and deflate said first chamber.

3. The inflatable bed as claimed in claim 1, wherein said unidirectional air inlet unit includes a check valve connected to said through hole.

4. An inflatable bed comprising:

an enclosure member defining a receiving space;

an inner partition sheet disposed within said enclosure member and dividing said receiving space into a first chamber and a second chamber;

said enclosure member includes a top sheet, a bottom sheet, and an outer peripheral sheet connected to said top and bottom sheets to define said first chamber, said inner partition sheet extending between said top and bottom sheets, and having a through hole formed therein, said inner partition sheet further having top and bottom ends connected respectively to said top and bottom sheets;

a first air valve attached to said enclosure member and communicating fluidly with said first chamber; and a unidirectional air inlet unit attached to said inner partition sheet and communicating fluidly with said first and second chambers;

wherein air from said first chamber enters said second chamber through said unidirectional air inlet unit;

said inflatable bed further comprising an air inlet/outlet tube having two opposite ends connected respectively to said outer peripheral sheet and said inner partition sheet, and a second air valve connected to said air inlet/outlet tube for controlling air flow through said air inlet/outlet tube.

* * * * *